United States Patent [19]

Beyer et al.

[11] 4,203,185

[45] May 20, 1980

[54] METHOD OF SEALING TUBE PLATE APERTURES, AND REPAIR SET FOR USE THEREIN

[75] Inventors: Nico H. H. Beyer, Heemstede; Johannes H. Huigen, Nootdorp; Johan K. van Westenbrugge, Schiedam, all of Netherlands

[73] Assignee: B.V. Neratoom, The Hague, Netherlands

[21] Appl. No.: 881,716

[22] Filed: Feb. 27, 1978

[30] Foreign Application Priority Data

Mar. 11, 1977 [NL] Netherlands ..... 7702668

[51] Int. Cl.[2] ..... B23P 15/26

[52] U.S. Cl. ..... 29/157.3 C; 29/157.4; 29/402.09; 165/71

[58] Field of Search ..... 29/157.3 C, 726, 727, 29/33 G, 157.3 R, 157.4, 527.6, 401 R, 401 C, 401 D; 113/118 V, 118 R; 165/70, 71

[56] References Cited

U.S. PATENT DOCUMENTS

| | | | |
|---|---|---|---|
| 2,209,975 | 8/1940 | Jacobus | 29/157.4 |
| 3,555,656 | 1/1971 | Brown et al. | 29/401 |
| 3,945,431 | 3/1976 | Straub | 29/157.4 |

FOREIGN PATENT DOCUMENTS

| | | | |
|---|---|---|---|
| 672399 | 10/1963 | Canada | 29/157.3 |
| 2458558 | 6/1976 | Fed. Rep. of Germany | 29/157.4 |

*Primary Examiner*—Francis S. Husar
*Assistant Examiner*—V. K. Rising
*Attorney, Agent, or Firm*—Kenyon & Kenyon

[57] ABSTRACT

A method of sealing tube plate apertures, e.g. in heat exchangers, and a repair set for use therein. It is known to seal a tube plate aperture by mounting a capped tube member therein. A disadvantage of the prior method is that the sealed aperture contains a fluid with a temperature different from that of the fluid in the non-sealed tube plate apertures, which results in stresses being generated in the tube plate and an increased danger of leakage. According to the invention this disadvantage is overcome by sealing the aperture in such a manner as to form an insulating space over the major part of the thickness of the tube plate.

5 Claims, 1 Drawing Figure

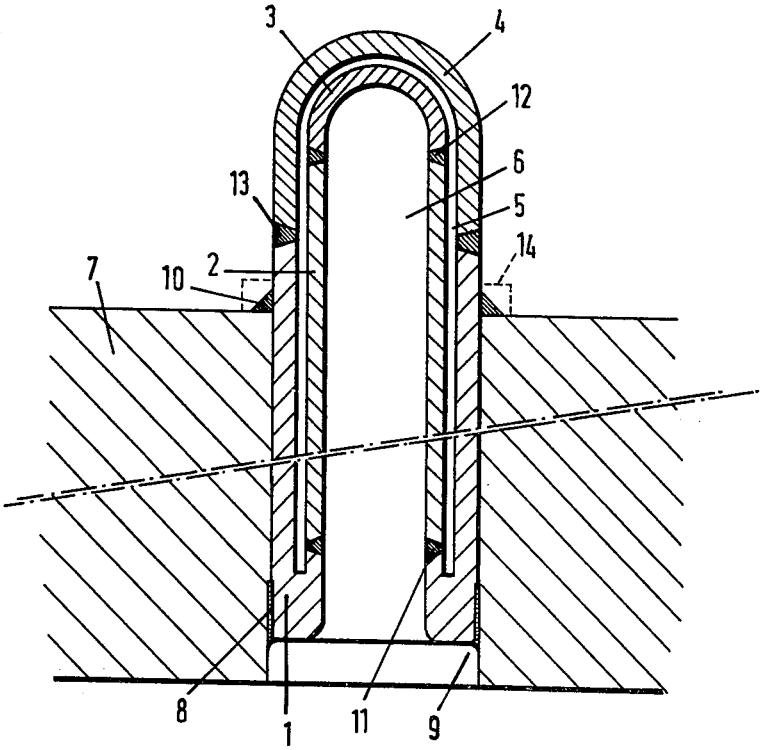
3
4
12
6
13
5
14
7
10
2
8
1
11
9

METHOD OF SEALING TUBE PLATE APERTURES, AND REPAIR SET FOR USE THEREIN

This invention relates to a method of sealing tube plate apertures in apparatus in which tubes through which a medium flows are surrounded by a different medium and terminate in tube plates, said method comprising applying in such tube plate apertures tube members projecting from said tube plates, and securing caps to said tube members to produce sealing plugs. The invention further relates to a repair set for use in said method.

Apparatus comprising a plurality of tubes through which a liquid, vapour or gas flows, the tubes themselves being surrounded by a different flowing fluid, is generally known. Such apparatus may be, for example, a heat exchanger. Heat exchangers are used in a large variety of technological processes. Another example is the steam generator, in which initially water flows through the tubes, said water being converted into steam upstream of the tube ends owing to heat exchange with the fluid on the outside of the tubes.

Heat exchangers and steam generators are applied, for example, in electrical power plants with a sodium-cooled nuclear reactor. In such systems, the steam driving the turbine of the plant is formed in steam generators in which the fluid providing the heat for the formation of steam is liquid sodium.

Generally speaking, and in particular in systems employing sodium and water or vapour, it is of importance that tube leakage is detected and eliminated. Methods of detecting leaky tubes are known to those skilled in the art. When a tube has been found to be leaky, it will be put out of operation. This is effected by temporarily putting the apparatus incorporating the tube out of operation, providing the tube concerned at both ends with extension pieces (e.g. in the form of sleeves) or applying these to the tube plate in which the tube terminates, and sealingly caps to these extension pieces. Furthermore, the tube is cut through adjacent one of its ends, so that when the apparatus is again put into operation, the fluid on the shell side of the tube plate, i.e., the fluid flowing around the non-defect tubes, entirely fills the treated tube. Cutting the tube, apart form the fact that the tube thus becomes readily accessible to the fluid on the shell side, is necessary to avoid the occurrence of thermal stresses.

A disadvantage of this method is that the tube plate is subjected to a non-uniform temperature load, because the shell space fluid penetrates into the tube plate at the point of the plugged aperture. The stresses resulting from a non-uniform temperature load involve an additional danger of leakage. In systems subject to severe safety requirements, such as nuclear plants, the occurrence of such stresses must be prevented as mush as possible.

It is accordingly an object of the present invention to provide a method of sealing tube plate apertures in apparatus in which tubes through which a fluid flows are surrounded by a different fluid, whereby to produce seals which do not have the disadvantage referred to or to a greatly reduced extend only.

This object is realized according to the invention by virtue of the use of such tube members and caps as to produce sealing plugs containing one or more insulating spaces over the major part of the thickness of the tube plates.

In a preferred embodiment, the method according to the invention comprises, after possibly reaming the tube plate aperture, mounting in succession (a) a first tube member, the wall of which is substantially a J-section (i.e. a U-section with unequal legs), with the shorter leg on the inside of the tube member, and the longer leg projecting from the tube plate;

(b) a second tube member having a diameter substantially equal to the diameter of said first tube member at said shorter leg;

(c) a cap fitting said second tube member; and (d) a cap fitting the longer leg of the first tube member.

An advantage of this preferred method is that it ensures that the weld connections made can be properly inspected, so that the method is highly suitable for applications subjected to severe safety requirements. Preferably, the first tube member is connected to the tube plate by explosive welding and over a portion of the tube plate aperture located on the side of the tubes. Any non-welded portion of the first tube member that is located on the side of the tubes relative to the explosive weld is preferably removed, as otherwise the slit present there involves an increased risk of corrosion. The first tube member may, however, be connected to this part of the tube plate in other ways, for example, by soldering.

A repair set for use in the method according to the present invention comprises:

(a) a first tube member, the wall of which is substantially a J-section, with the shorter leg on the inside of the tube member;

(b) a second tube member having a diameter substantially equal to the diameter of said first tube member at said shorter leg, (c) a third tube member closed on one end and open at the other, at which open end it has a diameter substantially equal to the diameter of the second tube member, and (d) a fourth tube member closed on one end and open at the other, at which open end it has a diameter substantially equal to the diameter of the first tube member at the longer leg.

By virtue of the method according to the present invention, there is obtained a seal for a tube plate aperture in the form of a sealing plug comprising at least one insulating space extending over the major part of the thickness of the tube plate. The first tube member, which is in contact with the tube plate and the wall of which has in section the shape of a J, is in contact with the shell space fluid over a small distance only. The major part of this tube member is insulated from the shell space fluid by the tube member secured to the shorter leg and the insulating space located between the two tube members. As a consequence, the tube plate is hardly affected by the temperature of the shell space fluid, which temperature differs from that of the fluid normally flowing through the tubes.

Modifications of the method and the repair set according to the invention are possible and may sometimes facilitate the performance and the use thereof, respectively. If, for example, the J-section tube member is provided with a collar on the outside of its longer leg, this tube member can quite easily be positioned in the tube plate aperture by virtue of such collar coming to rest on the tube plate. This collar may take the form, for example, of a support ring closely fitting around the portion of the J-section tube member projecting from the tube plate. Such a support ring makes it possible for the portion of the tube member located within the tube plate aperture to be connected to the tube plate by explosive welding throughout the thickness of the tube plate without leaving a slit between the tube member and the tube plate at the side of the tube plate away from the tubes. In that case a corner weld can be omitted.

One embodiment of the invention will now be described in more detail, by way of example, with reference to the accompanying drawing, which shows an axial section of a sealing plug made in accordance with the present invention.

Referring to the drawing, there is shown a first tube member 1, the wall of which has in section substantially the shape of a J, with the shorter leg on the inside of the tube member and the longer leg extending to a point outside a tube plate 7. Placed on the shorter leg of tube member 1 is a second tube member 2 having a diameter substantially equal to the diameter of tube member 1 at the shorter leg. A cap 3 is mounted on top of tube member 2, and a cap 4 on top of the longer leg of tube member 1. Between the longer leg of tube member 1 and cap 4, on the one hand, and the shorter leg of tube member 1, tube member 2 and cap 3, on the other, there is an insulating space 5, which insulates tube plate 7 from the shell space fluid within space 6. Reference numeral 8 designates an explosive weld. The non-welded portion of tube member 11 present on the side of the tubes relative to the explosive weld (designated by reference numeral 9) has been removed by a cutting operation to prevent the occurrence of slit corrosion. Sharp transitions have in addition been rounded. Furthermore, a corner weld 10 is shown, which connects the upper part of the longer leg of tube member 1 to the tube plate. Tube member 2 is connected to the shorter leg of tube member 1 by means of an internal bore tube-tube weld 11. The weld connections between tube member 2 and cap 3, on the one hand, and between the longer leg of tube member 1 and cap 4, on the other, are designated by reference numerals 12 and 13, respectively. An optional collar 14 is shown in dash outline, which serves to facilitate the positioning of tube member 1. Welds 8, 10, 11, 12 and 13 are applied in this order, i.e. in the order of increasing reference numerals.

The way in which the tube plate aperture is reamed, the welds are made, and inspected, does not constitute any problem to those skilled in the art. By virtue of the method according to the present invention it is possible, after weld 8 has been made, to test the same by means of, for example, ultra-sound, and subsequently, after weld 10 have been made, to check the same for example with a microfocus X-ray tube and/or other non-destructive testing techniques. After weld 10 and 11 has been made it can also be examined fully volumetrically, in a non-destructive manner, for example, by means of the microfocus X-ray tube, for which the film can be applied around this weld in the insulating space. Welds 12 and 13, finally, can be assayed by conventional, non-destructive testing methods.

We claim:

1. In a method of sealing an aperture through a tube plate of a heat exchanger, the tubeplate having a tube side and an accessible side, said method including sealingly installing one end of a tube member into the aperture from the accessible side of the tube plate, the other end of the tube member extending outwardly from the accessible side, and securing a sealing cap to said other end of the tube member, the improvement wherein the step of sealingly installing a tube member comprises: sealingly installing a double-walled tube member having concentric, spaced apart inner and outer tubes joined at the one end of the tube member, and the step of securing a sealing cap to the other end of the tube member comprises securing a first sealing cap to the other end of the inner tube and then securing a second sealing cap to the other end of the outer tube, so as to produce a sealing tube member having an annular thermally insulating space between the interior of the inner tube member and the outer tube member.

2. A method according to claim 1, in which the step of sealingly installing a double walled tube into the aperture which comprises (a) inserting a first tube member, the wall of which has in section substantially the shape of a J with the shorter leg on the inside of the tube member, into a tube plate aperture, with the base of the J being located on the tube side of the aperture and the longer leg extending outside the tube plate;

(b) sealingly connecting the outer wall of the first tube member at least at the base of the J to the inner surface of the tube plate aperture;

(c) sealingly mounting one end of a second tube member having a diameter substantially equal to that of said shorter leg of the first tube member onto the free end of said shorter leg, the outer surface of said second tube member being spaced from the inner surface of the longer leg of said first tube member.

3. A method according to claim 2, wherein the outer wall of the first tube member is sealingly connected by means of explosive welding to the inner surface of the tube plate aperture over a portion of the tube plate aperture surface located on the tube side of the plate.

4. A method according to claim 3, which further comprises removing any non-welded portion of the first tube member proximal to the tubes relative to the explosive weld.

5. A method according to any one of claims 2–4 comprising mounting a collar on the outside of said longer leg at a location spaced from the base of the J, such that the collar abuts the outer face of the tube plate when the first tube member is inserted into the tube plate aperture.

* * * * *